US006761351B1

(12) United States Patent
Howe

(10) Patent No.: US 6,761,351 B1
(45) Date of Patent: Jul. 13, 2004

(54) REGISTRATION SYSTEM EFFECTIVE DRIVE ROLL RADIUS COMPENSATION

(75) Inventor: Richard L. Howe, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/248,590

(22) Filed: Jan. 30, 2003

(51) Int. Cl.[7] ..... B65H 5/22

(52) U.S. Cl. ..... 271/3.15; 271/4.02; 271/4.09; 271/266; 271/265.01

(58) Field of Search ..... 271/3.13, 3.15, 271/4.02, 4.09, 4.1, 4.12, 10.02, 10.09, 270, 266, 265; 250/559.3; 198/792; 162/198, 263; 209/603

(56) References Cited

U.S. PATENT DOCUMENTS

| | | | | | |
|---|---|---|---|---|---|
| 4,986,528 | A | * | 1/1991 | Watarai et al. | 271/265.01 |
| 5,199,702 | A | | 4/1993 | Davis et al. | |
| 5,342,037 | A | | 8/1994 | Martin | |
| 5,483,893 | A | * | 1/1996 | Isaac et al. | 101/485 |
| 5,519,478 | A | | 5/1996 | Malachowski | |
| 5,794,176 | A | | 8/1998 | Milillo | |
| 5,983,066 | A | * | 11/1999 | Abe et al. | 399/394 |
| 6,029,020 | A | * | 2/2000 | Blackman et al. | 399/45 |
| 6,370,354 | B1 | * | 4/2002 | Chapman et al. | 399/394 |
| 6,374,075 | B1 | | 4/2002 | Benedict et al. | |
| 6,550,759 | B2 | * | 4/2003 | Kotaka et al. | 271/10.11 |
| 2002/0017755 | A1 | * | 2/2002 | Dobberstein et al. | 271/227 |
| 2003/0112020 | A1 | * | 6/2003 | Yankielun et al. | 324/644 |

OTHER PUBLICATIONS

U.S. patent application Ser. No. 10/248,591, Howe, filed Jan. 30, 2003, Co–pending.
"Lets End the Confusion", www.imaginationgallery.net/weight.html., Nov. 2002, 5pp.

* cited by examiner

*Primary Examiner*—Donald P Walsh
*Assistant Examiner*—Kenneth W Bower
(74) *Attorney, Agent, or Firm*—Oliff & Berridge, PLC

(57) ABSTRACT

Systems and methods of registration system control are provided that compensate for differences in physical properties of various substrates being transported through the system that impact velocity of the substrate. Exemplary systems of the Invention include at least one roll pair formed by a first, driven roll and a second roll defining a nip therebetween that is part of the transport path through which a substrate is passed. A prestored lookup table includes empirically-derived compensation factors for plural different kinds of substrates, with each compensation factor being based on physical characteristics of the substrate that impact displacement and velocity of the substrate along the transport path, such as the substrate's mass per unit area, which has been found to have a strong correlation with detected deviations in linear travel displacement and velocity. Upon input or determination of the substrate being registered, the system adjusts the drive profile of the drive roll by the compensation factor. This is preferably by substituting a derived effective drive roll radius value for the actual drive roll radius value in the drive control profile to correspond to the substrate being transported. A suitable compensation factor compensates for both the angular velocity of the drive roll and the amount of angular rotation so that the linear velocity of the substrate and the travel path length of the substrate are appropriated compensated.

21 Claims, 8 Drawing Sheets

REGISTRATION SYSTEM EFFECTIVE DRIVE ROLL RADIUS COMPENSATION

BACKGROUND OF THE INVENTION

1. Field of Invention

The invention relates to systems and methods for providing a compensation factor for a registration system that takes into account differing physical characteristics of. various substrates used in the system. In particular, a compensation factor, such as an empirically or theoretically derived effective drive roll radius, is stored for various substrates and used in drive roll control profile computations to provide process direction registration and velocity control of the substrates passing through the system.

2. Description of Related Art

There are a variety of transport and registration systems in use that transport and register various substrates, such as copy sheets. In many registration systems, such as those often found in copiers, facsimiles, and printers, drive mechanisms often include at least one driven elastomer-covered roll backed by a hard idler roll to form a roll pair defining a nip region therebetween. A substrate, such as copy paper, provided to the nip region is advanced by rotation of the roll pair, specifically rotation of the driven roll, which causes corresponding linear movement of the substrate, such as paper.

High quality documents require registration of sheets to a photoreceptive surface for image transfer. In order to achieve this, accurate registration control is needed to locate the sheet with respect to the image. Conventional machines use various types of sheet registration devices. Some sense the position of the sheet at a first location and use this sensed information to generate a set of control signals to cause the sheet to arrive at a second location in proper registry. Other systems compute or approximate sheet position indirectly based on known parameters of the registration system and sensed values of various drive elements.

In most conventional registration systems used for printers, copiers and facsimile machines, the types of substrates being transported usually do not vary much. That is. many systems typically encounter only a limited number of different substrate types, such as basic draft sheet stock of a certain weight in basic sizes such as A4 or 8.5×11 inches. A typical registration system is designed to transport, for example, 20 lb. bond sheet stock (roughly 75 grams/m$^2$ or GSM). Occasionally, higher quality bond paper of a slightly higher weight, such as 24 lb. bond (roughly 90 GSM) or 28 lb. bond (roughly 105 GSM) sheet stock is used. In conventional registration systems, these sheets are transported using the same drive profiles. That is, the drive control parameters are fixed (i.e., set irregardless of the weight of the sheet being used).

In conventional drive roll systems, angular velocity and degrees of rotation of the driven roll can be readily determined from conventional measurement systems, such as rotary encoders, or can be assumed to be known from the control parameters sent to the motor (as in stepper motor drive systems). From this information and knowledge of the roll radius of the drive roll, the system can, through equations, approximate the linear movement of the substrate passing through the nip region. This linear movement, including travel velocity, is relevant because various timing and other position control factors are based on the determined linear velocity of the substrate. For example, if it is desired that a substrate reach a desired position such as a leading edge transfer position 1000 mm from the drive roll at a given time t, through computation knowing both the distance (1000 mm) and the determined linear velocity (X mm/sec), the time to start the transport can be calculated. Alternatively, or in addition thereto, a desired velocity can be set to match other system components so that the substrate is desired at a select location at a desired speed and at a desired time based on the determined linear velocity.

SUMMARY OF THE INVENTION

In the United States, paperweight is expressed as pounds per 500 sheet ream of uncut C-size paper (4× letters size). As such, a cut ream of 20 pound letter paper (500 sheets of 8.5×11) would weigh 5 pounds. Because each type of paper has a different basis size, it is often confusing to talk in terms of the U.S. pound weight system. Instead, it is much more convenient to express paper "weight" as mass per unit area as in the ISO (metric) system In which the weight of paper Is given in grams per square meter (GSM). For example, 20 pound bond letter stock corresponds to roughly 75 GSM, 24 pound bond letter stock corresponds to roughly 90 GSM, and 28 pound bond letter stock corresponds to roughly 105 GSM. 20 pound Bristol board on the other hand, which has a different basis size, corresponds to roughly 44 GSM. Other known substrates can have substantially higher GSM, some over 300 GSM.

While prior printers, copiers and facsimile machines typically encountered only a handful of different types of substrates, such as A4 or 8.5×11" papers in only a small range of paper weights or densities, today there is a trend toward using more and more diverse varieties of substrates in such systems. Registration systems today thus may be required to accommodate delivery of a wide variety of substrates, each having diverse physical properties.

An exemplary system according to the invention is expected to support substrates between about 49 to 280 GSM (grams/m$^2$). However, the physics involved in transporting such substrates through a nip region results in slightly differing linear movement of the substrate given the same drive control profile for the drive roll that is driving the substrate. That is, it has been found that differing physical properties, such as, for example, substrate thickness, substrate stiffness, substrate mass per unit area, substrate coefficient of friction to the driven roll, and the like cause a variance in actual linear transport displacement and speed with a given fixed drive roll displacement and speed profile. Because the assumed linear speed of the substrate is used to control the registration system, Applicant has found that if there is no compensation for the variations in actual travel displacement and speed due to the physical differences in substrates being transported, the final registration and velocity of the substrate will vary correspondingly as the assumed displacement and velocity deviates from actual linear displacement and velocity.

Moreover, such variances in velocity may cause speed mismatches with other system components, causing undesirable effects on the substrate such as image quality defects, jams, or the like. As printing resolutions are becoming increasingly smaller, system tolerances have become similarly increasingly small. Accordingly, even seemingly small deviations may have intolerable effects on the resultant print system registration.

Because of this, there is a need for a method and system that can compensate the drive profile of the registration system to account for such deviations due to delivery of different substrates.

There also is a need to compensate for arrival time differences and/or substrate speed differences due to the use of substrates with different physical properties.

Exemplary systems and methods of the invention achieve this by providing a lookup table or other predefined compensation factor that accounts for differences in one or more physical properties of substrates being transported and registered so that the registration system will reliably register substrates, regardless of such differences in physical properties.

Exemplary systems of the invention may include at least one roll pair formed by a first, driven roll and a second roll defining a nip therebetween that is part of the transport path through which a substrate is passed. A lookup table including a compensation factor for plural different kinds of substrates is prestored, with each compensation factor being based on physical characteristics of the substrate that impact velocity of the substrate along the transport path. A particularly relevant compensation factor is an effective drive roll radius. A substrate determination device, such as an input from the operator of the system or an automatic detection system, determines the substrate being transported. A registration controller operably connected to the first roll controls a drive profile of the first roll. The drive profile is compensated by the compensation factor to adjust the drive profile to correspond to the specific substrate being transported.

Exemplary methods according to the invention may include: receiving an input selecting one of a variety of different substrate types to be registered by a registration system; accessing a prestored compensation factor corresponding to the selected substrate type that includes at least an effective drive roll radius based on at least the mass per unit area of the selected substrate type; adjusting the drive profile of the roll pair based on the obtained compensation factor; and driving the roll pair using the compensated drive profile.

BRIEF DESCRIPTION OF THE DRAWINGS

The invention will be described with reference to the following drawings, wherein.

DETAILED DESCRIPTION OF PREFERRED EMBODIMENTS

Figure 1:
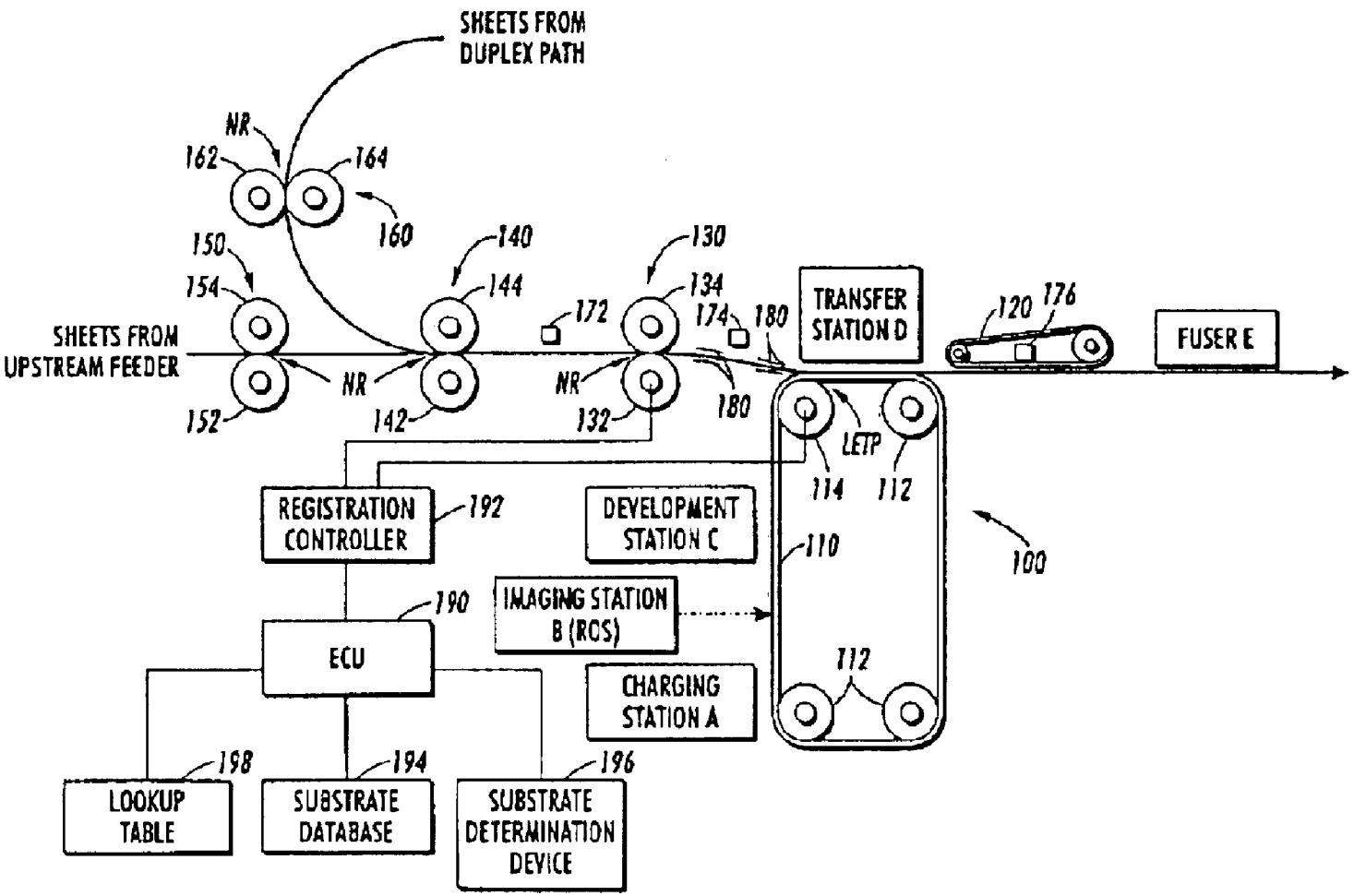
FIG. 1 shows a schematic representation of an exemplary electrophotographic machine incorporating a registration system according to an embodiment of the invention.

For a general understanding of an electrophotographic printer or copying machine in which the features of the invention may be incorporated, reference is made to FIG. 1, which depicts schematically various key components thereof. Although the invention for accurately transporting and registering a broad array of substrate types along a predetermined path is particularly well adapted for use in such a machine, it should be apparent that this embodiment is merely illustrative. Rather, aspects of the invention may be achieved in any registration system in which a broad number of substrate or media types need to be advanced and registered in a precise, accurate manner and the drive system Includes one or more roller pairs or drive nips whose displacement and velocity performance varies with properties of the substrate or media being driven.

In FIG. 1, electrophotographic printer (copier) 100 employs a conventional photoconductive belt 110 assembly having a photoreceptive surface on which one or more images can be provided. Alternatively, any other conventional or subsequently developed photoreceptive surface may be provided. For example, it is also well known to use a drum having a photoconductive surface instead of the belt.

Belt 110 moves in the direction of the arrow (clockwise) to advance successive portions sequentially through various processing stations disposed about the path of the belt. Belt 110 is advanced by way of a series of rolls 112 and at least one drive roll 114 at a predetermined process speed as known In the art. Initially, a portion of the photoconductive surface of belt 110 passes through a charging station A. Here, one or more corona generating devices charge the photoconductive belt 110 to a relatively high uniform potential. Then, the charged portion Is advanced through imaging station B.

At imaging station B, an imaging system such as a raster output scanner (ROS) 120 discharges selectively those portions of the charge corresponding to image portions of the document to be printed or reproduced. This records an electrostatic latent image on the photoconductive surface. ROS 120 may be any conventional or subsequently developed scanner, typically including a laser with a rotating polygon mirror block. However, other imaging systems can be employed, for example, an LED write bar or a projection liquid crystal display (LCD) or other electro-optic display.

Thereafter, belt 110 advances the electrostatic latent image recorded thereon to development station C which, for example, could be any conventional or subsequently developed system, such as a magnetic brush development station. At station C, toner particles are attracted to the electrostatic latent image to form a toner powder Image on the conductive surface of belt 110. Belt 110 then advances the toner powder image to transfer station D.

At transfer station D, a substrate S, such as a copy sheet of paper, is moved into contact with the toner powder image. Copy sheet S is advanced by a sheet registration system from an upstream supply, such as from an upstream feeder or a duplex path, to a leading edge transfer position LETP close to belt 110 by at least one roll pair, such as exemplary roll pairs 130, 140, 150 and 160 shown. Each roll pair consists of a driven roll (132, 142, 152, 162) backed by an opposing hard idler roll (134, 144, 154, 164) that define a nip region NR therebetween. While only single roll pairs are shown in the side view, there are preferably two roll pairs at each location, one outboard and one inboard in the width direction of the sheets S (transverse to the process direction).

Driven rolls 132, 142, 152, 162 are driven by a drive mechanism, such as a drive motor operably coupled to the roll. Suitable coupling may be through a drive belt, pulley, output shaft, gear or other conventional linkage or coupling mechanism. An exemplary drive mechanism is better described below with reference to FIG. 2.

Substrate transportation is achieved by rotation of the roll pair, which causes corresponding linear movement of the substrate (copy sheet S) through the nip region. The position, timing and velocity of the substrate is controlled by registration controller 192, which receives signals from ECU 190, which is associated with a substrate database 194 and a substrate determination device 196.

Then, transfer is achieved through conventional or subsequently developed devices, such as, for example, a corona generating device that charges the copy sheet to a proper magnitude and polarity so that the copy sheet becomes attracted to and in contact with the toner powder image on the surface of belt 110, at which time the powder toner image is attracted from the belt onto the copy sheet S. After transfer, the corona generating device charges the copy sheet to an opposite polarity to detach the copy sheet from belt 110. Copy sheet S is then advanced to fusing station E, such as by pre-fuser transport conveyor 120.

Copier 100 includes various sensors along the transport path that monitor various movements through the path, such as nip release sensor 172, skew sensor 174 and pre-fuser transport sensor 176 as known in the art.

Fusing station E Includes a fuser assembly, which can consist of conventional or subsequently developed fuser elements, such as the shown heated fuser roll and a pressure roll as known in the art. After fusing, the copy sheet S having a fused image thereon may be advanced to an output tray (unshown) or other post-processing device, such as a binder, finisher, collator or stapler.

Figure 2:
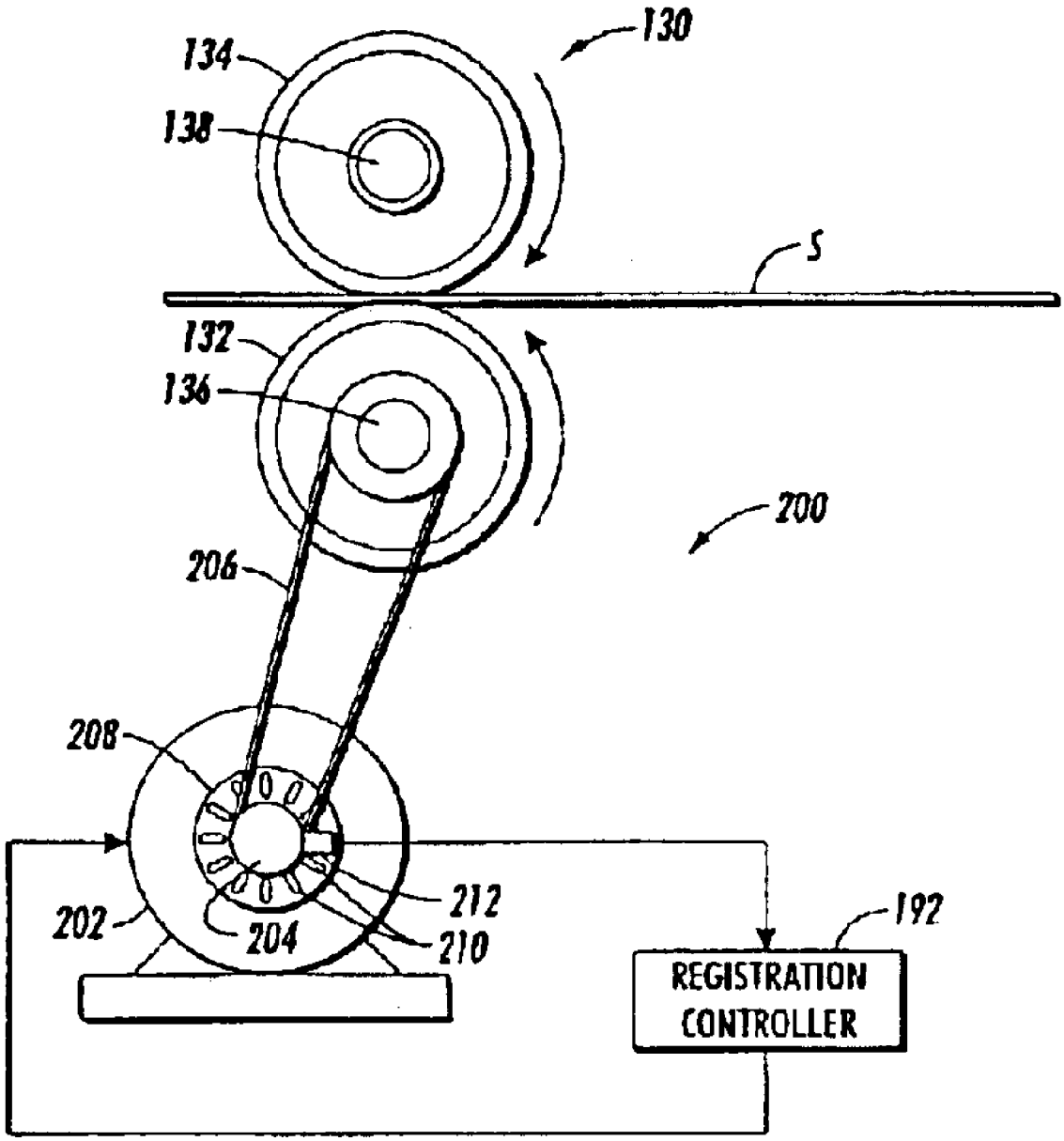
FIG. 2 shows an exemplary driven roll pair according to an embodiment of the invention.

An exemplary drive mechanism 200 for driving a roll pair, such as roll pair 130 is better illustrated in FIG. 2. Drive mechanism 200 includes motor 202 having a shaft 204 operably connected to a corresponding shaft 136 of driven roll 132 through a linkage mechanism, such as the belt 206 shown. Motor 202 is preferably an open-loop stepper motor. However, a feedback-controlled servo motor, controlled by PWM or encoder feedback, or other DC or AC motor may be substituted. An example of an encoder-driven servo motor system can be found in U.S. Pat. No. 5,519,478 to Malachowski, the subject matter of which is incorporated herein by reference in its entirety. In the case of use of an optional servo motor, motor 202 may further be provided with an encoder disk 208 mounted to shaft 204. Such an encoder disk has a series of radially spaced markings 210 that can be sensed by a photoelectric sensor 212.

In the case of an exemplary stepper motor, controller 192 provides instructions to motor 202 in the form of stepper motor counts instructing the motor how many turns (or steps) to advance. These values or instructions in terms of stepper motor counts are determined in advance. Because there is no feedback in such a system, it is assumed that such advancement takes place. In the case of use of an alternative servo motor, a feedback loop is provided. In particular, as the shaft 204 rotates, disk 208 rotates in unison therewith and the shaft encoder 208, 212 generates an output signal indicative of the rotational speed of the motor 202 in the form of a number of pulses or counts generated in each revolution of the shaft. Accordingly, a period between the beginning and end of each revolution is signified by respective index pulses generated by the reference markings 210 on disk 208. This output is fed to controller 192, which can include its own central processing unit (CPU) or can derive its processing power from ECU 190. Additionally, controller 192 can include RAM, ROM, and I/O devices for interfacing with motor 202. Because idler roll 134 contacts driven roll 132, rotation of driven roll 132 In a direction about shaft 136, such as the counterclockwise direction shown, causes an opposite rotation of idler roll 134 about its shaft 138, such as the clockwise direction shown.

Figure 3:
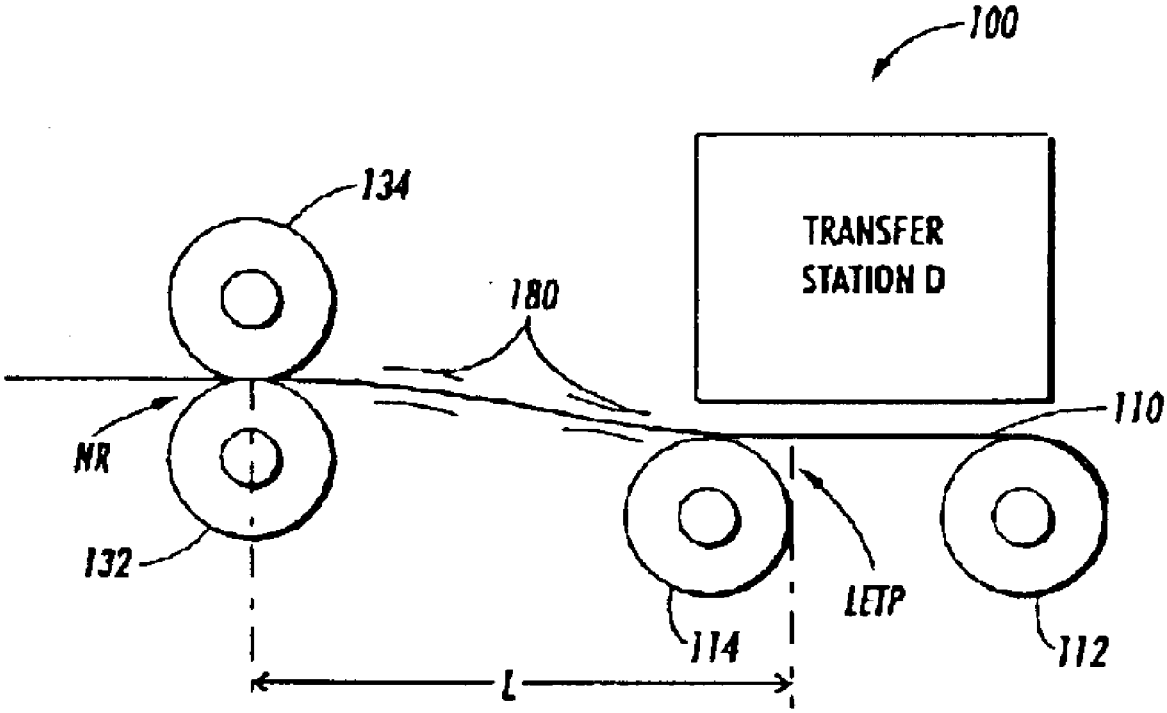
FIG. 3 shows a portion of the transport path of the substrate between a last drive roll pair and a photoreceptor in the electrophotographic machine of FIG. 1.

Referring to FIGS. 1 and 3, in the exemplary copier 100, a nominal distance L along the paper transport path from the registration system drive roll nip NP of roll pair 130 to a point on the photoreceptor where the leading edge of an exemplary transport substrate, such as a 75 GSM paper with no curl, achieves tangency is approximately five inches. The tangency point may be referred to as the leading edge transfer position (LETP).

Actual movement of sheets being driven by a drive roll pair, such as an elastomer-covered drive roll backed by a hard idler roll is an outcome of a large number of physical properties of both the drive roll nip and the substrate passing through it. Regarding the substrate itself, these properties potentially include substrate thickness, substrate mass per unit area, substrate bending stiffness, and substrate coefficient of friction to the driven roll. While the registration system drive roll is intended to deliver sheets at a nominal process speed, typically on the order of 20 inches/sec, it has been found that the actual speed of sheets delivered varies over a range of approximately ⅓ of a percent of process speed depending on the substrate delivered, which can vary from, for example, 50 to 275 GSM.

Because system parameters in previous registration systems were designed with a fixed process speed that did not take into effect any differences in physical properties of the substrate being registered, control and timing errors occurred. For example, because the system is set up to assume that the substrate will cover the nominal distance from the registration drive nip to the point of tangency in a fixed, constant amount of time, the actual distance of travel the substrate will cover In that amount of time will deviate by up to about ⅓ of a percent. Over an exemplary travel distance of about five inches, this could result in a registration error of up to approximately 0.016 inches (0.4 mm). For larger travel distances in other registration systems, the error will obviously increase. This amount is over half of an entire desired print system process direction registration specification. Because of this, even though the displacement and velocity change with substrate is subtle, It has been found to have non-negligible effects on registration system performance, which effect the overall image quality, reliability, and customer satisfaction of the copier or other device in which the registration system is associated. As such, it has been found desirable to devise methods and systems to account for such deviations.

One suitable method of compensation would be to determine what the arrival time variations would be with different substrates and then advance or retard the registration system timing accordingly to account for the variation. This exemplary method addresses variations in arrival times at transfer zones to accommodate process direction registration variation. However, it fails to address another failure mode due to the variance. This additional failure is the speed mismatch between the registration system and a transfer/detach zone (roughly the area under transfer station D where the substrate is in contact with the belt 110) when a substrate is simultaneously in both systems. This may result in possible image quality defects, such as smears from the mismatch. As such, it is desirable to also correct and appropriately match the velocity of the substrates through the registration system.

An exemplary method of addressing both potential failure modes simultaneously compensates for both the arrival time difference and the substrate speed difference caused by physical differences in different substrates. This is achieved by deriving a compensation factor for use in a drive mechanism control profile that adjusts for a change in substrate speed as a function of one or more physical properties of a substrate type. One particularly useful embodiment of such is a compensation factor coined as an "effective drive roll radius." That is, for any given substrate, it is assumed that the linear position of the sheet is proportional to the angular position of the registration system drive roll, but for different substrates it is assumed that the constant of proportionality is different. This constant of proportionality provides a compensation factor that converts the actual drive roll radius to an effective drive roll radius. By substituting this effective drive roll radius for the actual radius value, a corrected angular displacement of the drive roll can be computed that results in constant linear displacement of all substrates and a corrected substrate drive roll speed can be calculated that results in all substrates traveling at a speed that more closely matches a given desired speed.

One prime correlation factor of the various different substrate physical properties is a sheet's mass per unit area, often calculated in grams/$m^2$ (GSM). Significant testing was conducted on an exemplary registration system using a wide variety of substrate types and GSMs to determine a compensation factor (in the exemplary case, the effective drive roll radius) as a function of substrate GSM. This was achieved by precisely measuring the actual velocity of sheets as they were driven by the registration system drive rolls turning at a fixed, known angular velocity. This testing has provided data used to derive effective compensation factor(s) for each type or category of substrate being used.

Figure 4:
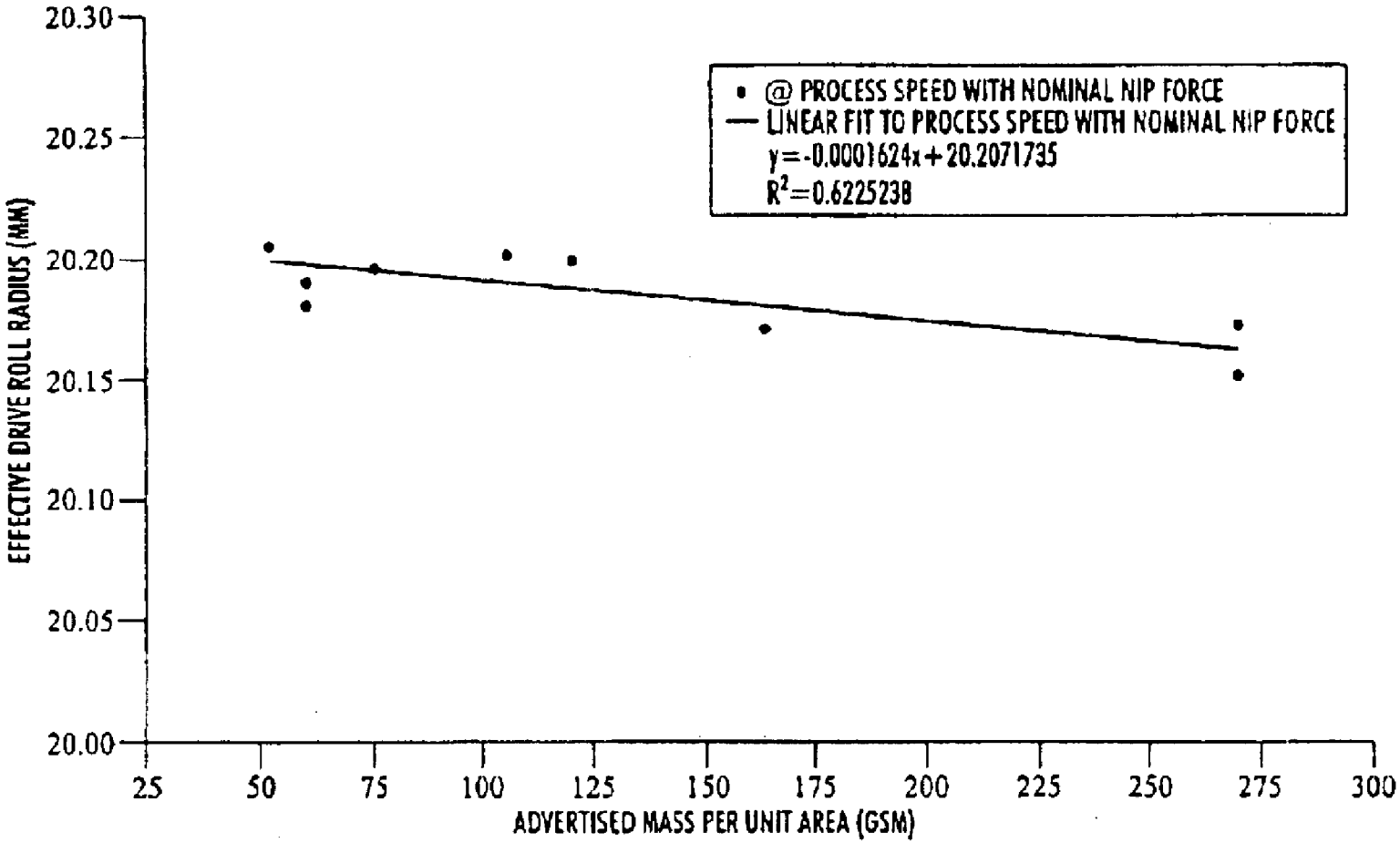
FIG. 4 shows a chart plotting effective drive roll radius according to the invention.

FIG. 4 provides a chart that plots representative actual test data for various substrates having differing GSMs. From this, it was determined that although each substrate was transported using the same roll pair having a nominal roll diameter of 20 mm, different substrates acted as if they were being driven by a drive roll with a different diameter. That is, while it was often assumed that the roll diameter and angular velocity of the roll could be used to determine linear movement of the substrate, In actuality, different substrates act differently under the same control profile Thus, it was deduced that an "effective drive roll radius" could be determined that was an outcome of at least some, if not all, of the various physical property differences between substrates. From this testing, an equation was derived for determining an effective drive roll radius based on GSM. As shown, while a relatively standard 75 GSM paper was found to have an effective drive roll radius of approximately 20.195 mm, higher density substrates, such as 270 GSM substrates, can have a reduced effective drive roll radius of approximately 20.16 mm. Thus, even though the system uses the same drive roll pair, variations In travel velocity and distance traveled can be compensated by substituting the effective drive roll radius for the actual roll radius into equations used to compute registration drive roll profiles. Providing compensation factors that correlate with differing physical characteristics of the substrate, such as GSM, are not limited to an effective drive roll radius. Additional factors, such as a path length adjustment value, can also be separately derived to adjust registration and drive profiles to other types of substrates. See co-pending Application Ser. No. 10/248,591, the subject matter of which is incorporated herein by reference in its entirety.

Two implementations of a copier incorporating a compensated registration system are contemplated. In a first, the copier is intended for a high end user, such as a graphic artist or press operator in a commercial print shop where high-end machines are being used. In such an application, the operator is typically very knowledgeable about the particular copy and print services being used, as well as the various media/substrates desired and used. As such, in this embodiment, an operator is likely knowledgeable enough to appropriately select from a large number of available media/substrate the correct media/substrate being used for a particular job. This information can be entered by way of keyboard, touchscreen or any other input device suitable as substrate determination device 196 in FIG. 1. One suitable exemplary embodiment would display available media from a media database resident in the machine to a display for the operator to review and select from.

A second implementation is for more low-end copiers or copiers Intended for general walk-up use. In such an environment, the operators are usually less sophisticated. As such, it may not be reliable or desirable to have such an operator identify the media/substrate being used from a large number of substrate possibilities. This Is particularly the case when physical properties of the substrates, such as GSM, are often unknown to the less-skilled user. As such, for this application, it would be more convenient (and more reliable) for the operator to have a much simpler, reduced subset of media types to distinguish among. For example, it may be convenient to have all media/substrates be categorized into three groups: lightweight substrates, normal or medium substrates, and heavyweight substrates. Such a reduced set of media types makes it easier for a less sophisticated operator to select a substrate type that best represents characteristics of the substrate being used, while still providing a mechanism that fairly reliably compensates for registration of a wide variety of substrates having differing physical properties that effect registration.

Figure 5:
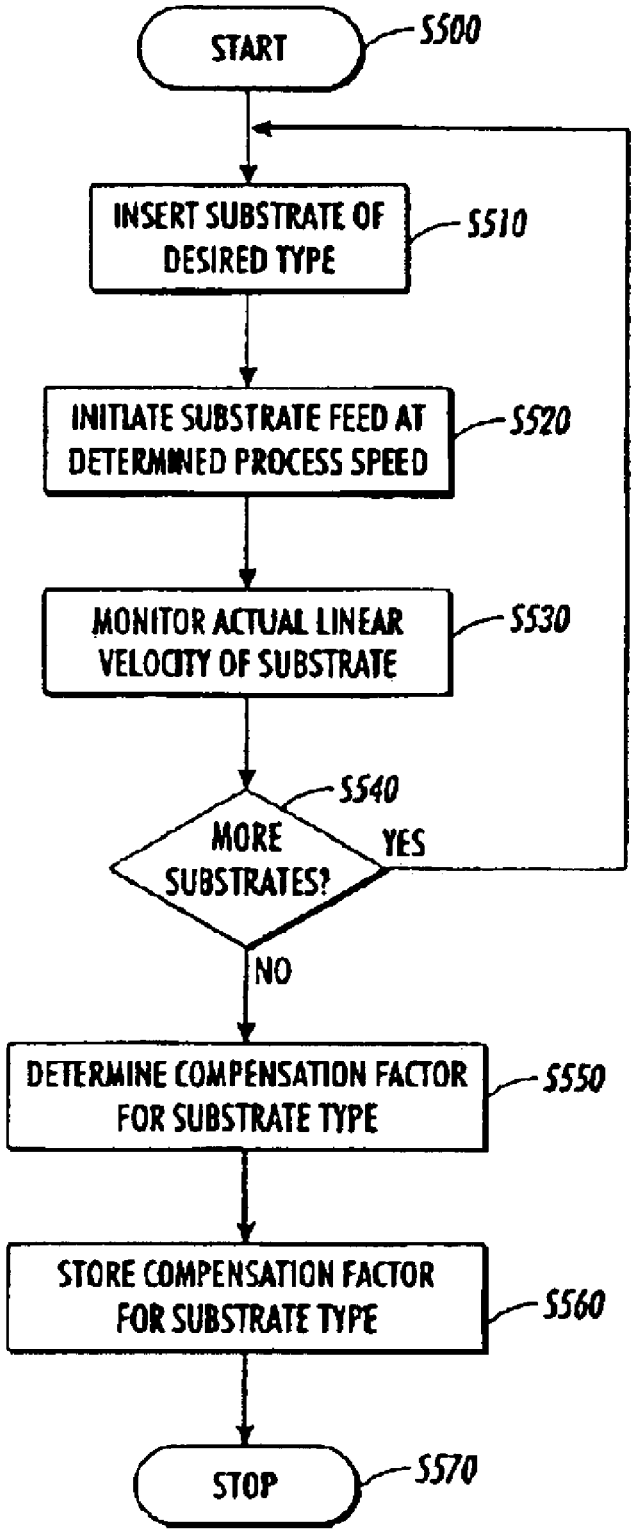
FIG. 5 shows a flowchart of a first exemplary method for measuring and determining a compensation factor according to the invention.

A first exemplary method of obtaining empirically-derived compensation factors for the first implementation (press operators) is shown in FIG. 5. The process preferably uses a test registration system that simulates or is equivalent to one for which compensation factors are to be provided. In this case, the exemplary process uses a registration system similar to that shown In FIG. 1. However, for empirical data acquisition, the test registration system has additional sensors than those typically found on an actual system in use. These additional sensors are provided to obtain precise measurements of the actual travel path and velocities encountered by various substrates through the registration system so as to compute or ascertain an appropriate compensation factor.

The process starts at step S500 and advances to step S510 where a first substrate type having first characteristic physical properties is inserted Into the registration system for testing. This substrate may be categorized by some individual or collective physical property attribute(s), such as, for example GSM, size, etc. Then, at step S520 a substrate feed process is initiated, at which time the first substrate is fed at a predetermined drive roll or drive system speed through the registration system. From step S520, flow advances to step S530 where the actual linear velocity of the substrate (and possibly other sensed values) is monitored. For example, the actual time needed to advance the substrate to a predetermined location may be sensed and used to calculate an actual velocity profile for the substrate given a known process speed of the drive roll pair from another sensor such as a rotary encoder. Additionally, multiple spaced sensors may be provided along the transport path to sense velocity by measuring timings between various locations to give a more detailed velocity profile. Upon completion, flow advances to step S540 where it is determined whether additional substrate types are to be tested. If so, flow returns to step S510. If not, flow advances to step S550 where a compensation factor is determined for each specific substrate type.

One suitable exemplary compensation factor is an effective drive roll radius used to compute linear velocity of the substrate based on sensed angular velocity of the drive roll by a rotary encoder. For example, the linear fit equation determined in FIG. 4 may be used to derive an effective drive roll radius for substrates having any GSM. Alternatively, an actual determined effective drive roll radius for a particular substrate type tested may be used. For example, the specific type of substrate tested in FIG. 4 having a GSM of about 165 was found to have an effective drive roll radius of about 20.17 mm. This value could be used for that particular substrate type.

From Step S550, flow advances to step S560 where the various compensation factors are stored, such as in a lookup table 198 in memory for subsequent retrieval during registration processing. One exemplary embodiment of such a lookup table would be indexed by GSM and would have associated therewith an appropriate compensation factor, such as effective drive roll radius. Upon completion, flow advances to step S570 where the process stops.

Figure 6:
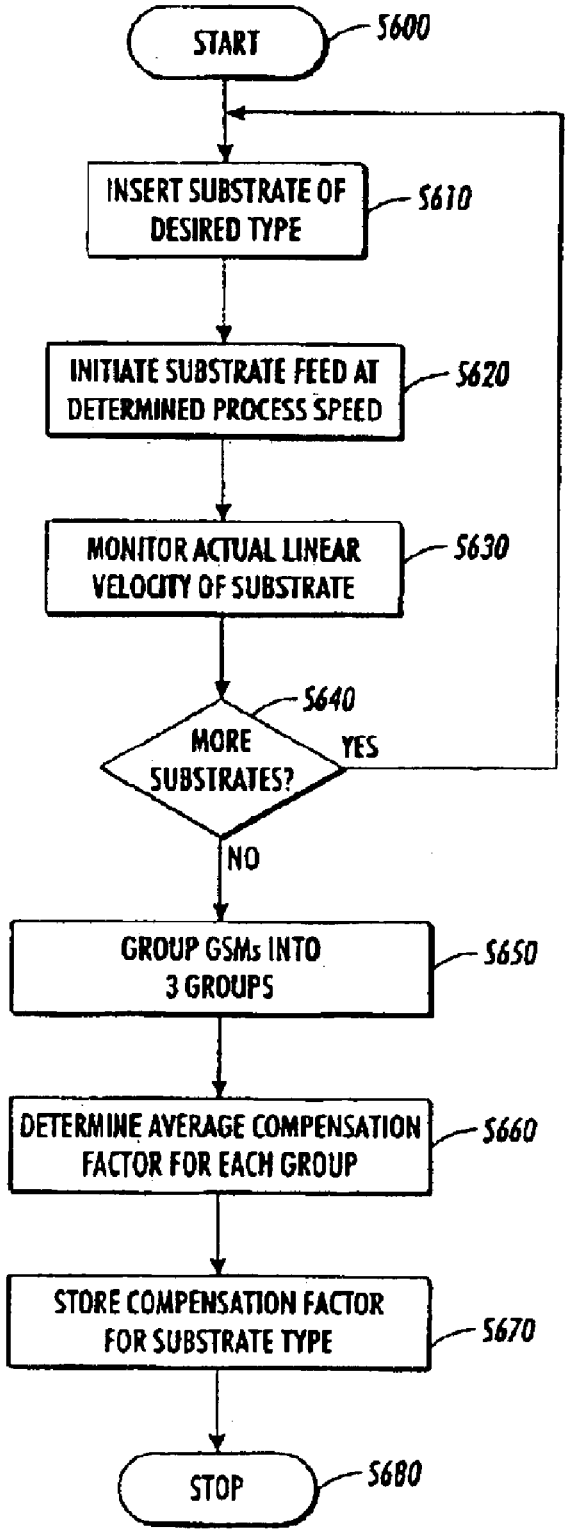
FIG. 6 shows a flowchart of a second exemplary method for measuring and determining a compensation factor according to the invention.

A second exemplary method of obtaining compensation factors for the second implementation (walk-up operators) is shown in FIG. 6. The process again preferably uses a test registration system that simulates or is equivalent to an actual registration system, but Is provided with additional sensors to obtain precise measurements of the actual velocities encountered by various substrates through the registration system.

The process steps S600 to S640 correspond to steps S500 to S540 in FIG. 5.

However, the process differs starting at step S650 where after completion of testing of all substrates, the overall range of GSMs tested is broken down into a finite number of sub-group ranges, preferably 3 groups. For example, when the GSMs being used range from between 50 to about 275 GSM, the three range sub-groups could be:

Group 1 with a range of less than 75 GSM; Group 2 with a range between 75 to 200 GSM; and Group 3 with a range of over 200 GSM. These groupings generally correspond to lightweight, normal and heavyweight substrates, respectively.

Then, at step S660, an average compensation factor is determined for each grouping. An example of this can be derived from the test data shown in FIG. 4. An exemplary embodiment where the compensation factor is an effective drive roll radius has effective drive roll radii of 20.195, 20.190, and 20.170, respectively for the above three groups. Then, at step S670, the determined compensation factors are stored for each substrate group, such as in a lookup table 198 stored in memory. Then, the process stops at step S680.

While the exemplary "effective" values are based on an actual roll diameter of 20 mm, it should be apparent that appropriate "effective" roll diameters will change depending on the particular size, configuration, and properties of the drive roll used in the particular application. However, such values would be similarly determinable from the empirical testing of various substrates on a machine having such a different roll pair. Alternatively, mathematical modeling could be performed to provide a theoretically-derived compensation factor that accounts for differing physical characteristics of various substrate types.

Figure 7:
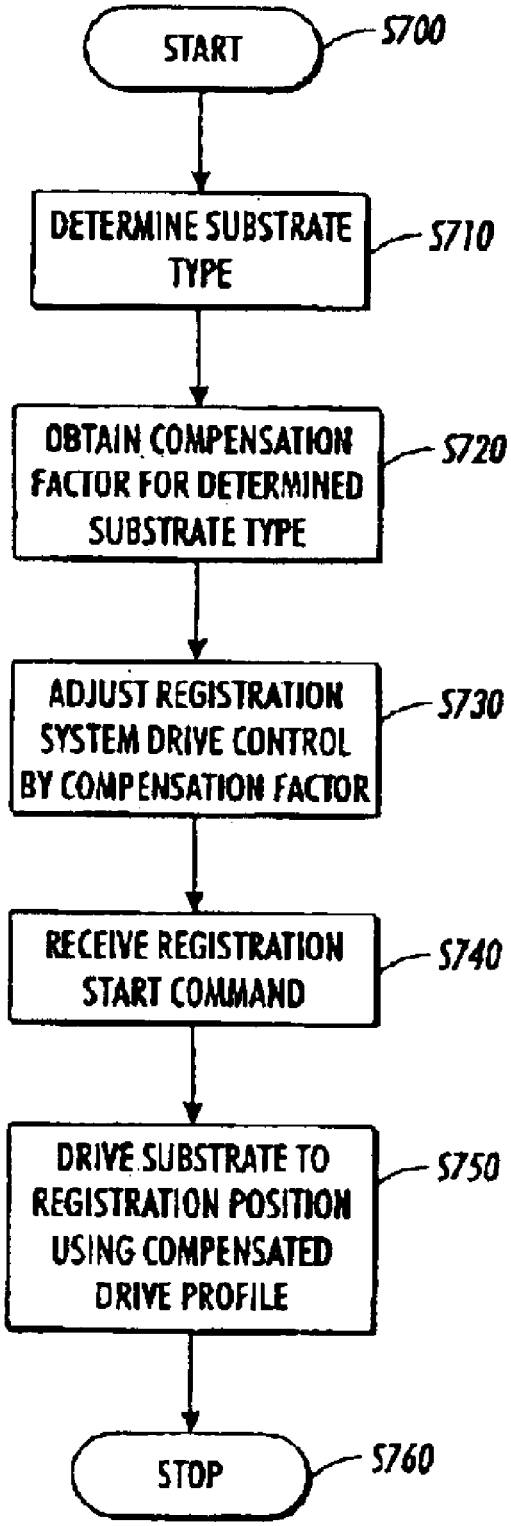
FIG. 7 shows a flowchart of a first exemplary method of registering sheets of various types and physical properties according to the Invention.

A first exemplary method of operation of the registration system within a copier or other transport device will be described with respect to FIG. 7. The process starts at step S700 and proceeds to step S710 where a substrate type is determined. In exemplary embodiments, the determination is manually made by a system operator. This may be achieved through substrate determination device 196, which may be any known or subsequently developed input device, such as a keyboard, touchscreen, switch, etc., capable of selecting a desirable substrate type to be used. However, it is also possible for the selection to be automatically made by an automated substrate determination device 196. For example, the fuser nip sheet basis weight detection system of U.S. Pat. No. 5,519,478 to Malachowski, commonly assigned to Xerox Corporation, the subject matter of which is incorporated herein by reference In its entirety, could be used at an upstream roll pair to detect sheet/substrate basis weight (or GSM) and this information could be used to control operation of downstream roll pairs in the registration system.

From step S710, flow advances to step S720 where a compensation factor is obtained for the determined substrate type. This may be, for example, by retrieving the corresponding factor from lookup table 198 for the particular substrate determined to be present. Alternatively, the compensation factor could be computed by using the determined GSM and using the equation such as that provided in FIG. 4.

While in exemplary embodiments, it is possible to provide a lookup value with a compensation factor such as an effective drive roll radius for each different type or variety of substrate, such an embodiment is more memory intensive and software complex. An alternative would be to groups two or more substrates into various subgroups. For example, because GSM is a primary determinative physical characteristic, the whole range of GSM can be subdivided into ranges of GSM in which a same lookup value or compensation factor will be used as in the FIG. 5 embodiment. That is, in an exemplary embodiment where the range of GSMs is broken down into groups, each of these groups could have associated therewith a stored effective drive roll radius as a compensation factor for that group that corresponds to the average variation of the group. Although this may not be as accurate as use of individual compensation factors for each substrate type, the compensation can be an improvement over no compensation at all.

From step S720, flow advances to step S730 where the registration drive control is adjusted by the compensation factor, such as an effective drive roll radius. Then, at step S740, a registration start command is received indicating that a substrate is desired to be registered in copier 100. From step S740 flow advances to step S750 where using the compensated drive profile, the drive roll of the registration system is driven to drive the substrate to a desired registration position. Upon completion, flow advances to step S760 where the process stops.

Figure 8:
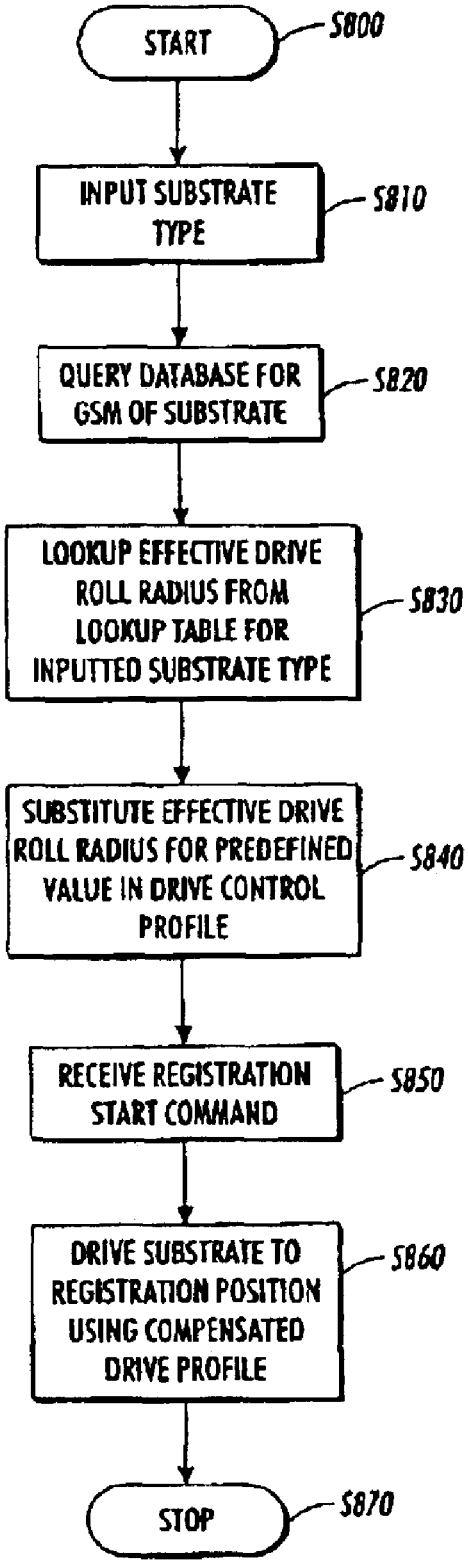
FIG. 8 shows a flowchart of a second exemplary method of registering sheets of various types and physical properties according to the invention.

A more detailed exemplary process is outlined in FIG. 8. The process starts at step S800 and proceeds to step S810 where a substrate type is input. In exemplary embodiments the determination is manually made by a system operator. This may be achieved through substrate determination device 196, which may be any known or subsequently developed input device, such as a keyboard, touchscreen, switch, etc.

In exemplary embodiments, copier 100 includes a media/substrate database 194 that contains pertinent information for each substrate used in the system. Media database properties may include, for example, GSM, thickness, whether the substrate has holes or not, whether the substrate is coated or not, etc. Each substrate or category of substrates is given a database ID number that Is associated with various properties of that media substrate. Of these, a particularly relevant property is the substrate's GSM. In a preferred embodiment, all or at least relevant portions of the database 194 may be displayed to the operator for the operator to select from by way of the input device 196, which can select the appropriate ID number in the media database for a desired substrate.

From step S810, flow advances to step S820 where media database 194 is queried for the corresponding GSM of the selected substrate. Then, flow advances to step S830 where the GSM is used to lookup the corresponding compensation factor, such as effective drive roll radius. From step S830, flow advances to step S840 where the registration drive control is adjusted by the compensation factor, such as an effective drive roll radius. Then, at step S850, a registration start command is received indicating that a substrate is desired to be registered in copier 100. From step S850 flow advances to step S860 where using the compensated drive profile, the drive roll of the registration system is driven to drive the substrate to a desired registration position. Upon completion, flow advances to step S870 where the process stops.

Thus, with the invention, system hardware or software within registration controller 192 can use the effective drive roll radius or other compensation factors in its computation of one or more sets of information it sends to firmware to control operation of the registration system and its drive roll(s). One such piece of information is the actual angular speed at which to run the registration system drive rolls so as to yield a desired linear substrate speed. Another piece of information is the number of revolutions the registration system drive rolls must turn so that the sheet will traverse an appropriate distance from the registration system to a delivery point, such as a transfer/detach zone. Both of these variables are based on the diameter of the drive roll. As such, the correction factor which substitutes a more appropriate "effective" drive roll radius is able to better compute a drive control profile that more closely approximates a desired linear displacement and velocity of the substrate itself. This information may also include determination of lead edge arrival timing adjustments. These signals are often in the form of stepper motor step counts. By factoring in the effective drive roll radius into the normal equations used, the stepper motor counts can be appropriately adjusted to provide a more accurate registration control.

While this invention has been described in conjunction with various exemplary embodiments, it is to be understood that many alternatives, modifications and variations would be apparent to those skilled in the art. Accordingly, the preferred embodiments of this invention, as set forth above are intended to be illustrative, and not limiting. Various changes can be made without departing from the spirit and scope of this invention.

What is claimed is:

1. A registration system for transporting and delivering various substrates along a transport path to a predetermined destination location at a desired timing, comprising:

at least one roll pair formed by a first, driven roll and a second roll defining a nip therebetween that is part of the transport path through which a substrate is passed;

a lookup table including a compensation factor for plural different kinds of substrates, each compensation factor including an effective drive roll radius that is based on physical characteristics of the substrate that impact displacement and velocity of the substrate along the transport path;

a substrate determination device that determines the substrate being transported; and a registration controller operably connected to the first roll to control a drive profile of the first roll, wherein the drive profile is compensated by the compensation factor to adjust the drive profile to correspond to the substrate being transported.

2. The registration system according to claim 1, wherein the differing characteristics include at least one property selected from the group consisting of substrate thickness, substrate stiffness, mass per unit area, and coefficient of friction.

3. The registration system according to claim 1, wherein a plurality of substantially similar substrates are grouped together and assigned a same compensation factor.

4. The registration system according to claim 3, wherein substrates are grouped into at least categories of light, medium and heavy substrates as determined by mass per unit area of the substrates.

5. The registration system according to claim 4, wherein said light category has a GSM range of less than about 75 GSM, said medium category has a GSM range of between about 75 to 200 GSM, and said heavy category has a GSM range of greater than about 200 GSM.

6. The registration system according to claim 1, wherein the compensation factor is based on the mass per unit area of the substrate.

7. The registration system according to claim 1, wherein the substrate determination device includes a user selectable input device.

8. The registration system according to claim 1, further comprising a substrate database of physical properties associated with each of several different substrates.

9. The registration system according to claim 1, wherein the drive control includes a parameter based on an actual drive roll radius, and the compensation factor provides an empirically determined effective drive roll radius parameter that is substituted for the actual parameter to compensate for the particular substrate being transported.

10. The registration system according to claim 1, wherein the compensation factor adjusts both the actual angular speed of the drive roll and the number of revolutions of the drive roll to yield a desired linear substrate speed and displacement for the selected substrate type.

11. The registration system according to claim 1, wherein the compensation factors are empirically-derived.

12. A registration system for transporting and delivering various substrates along a transport path to a predetermined destination location at a desired timing, comprising:

at least one roll pair formed by a first, driven roll and a second roll defining a nip therebetween that is part of the transport path through which a substrate is passed;

an input device that selects one of a plurality of different kinds of substrates to be transported;

stored predefined compensation factors for plural different types of substrates, each compensation factor including an effective drive roll radius that is based on a physical property of the substrate that impacts travel velocity of the substrate along the transport path, including at least the mass per unit area of the substrate; and a registration controller operably connected to the first roll to control a drive profile of the first roll, wherein the drive profile is adjusted by the compensation factor to adjust the drive profile to correspond to the substrate being transported.

13. The registration system according to claim 12, wherein a plurality of substrates are grouped together by similarity in mass per unit area and assigned a same compensation factor.

14. The registration system according to claim 13, wherein substrates are grouped into at least categories of light, medium and heavy substrates as determined by mass per unit area of the substrates.

15. The registration system according to claim 12, further comprising a substrate database listing one or more physical properties of each said substrate type.

16. The registration system according to claim 12, wherein the prestored compensation factor is an empirically-derived equation that includes mass per unit area as an input variable.

17. A method of registration system control for a registration system having at least one roll pair formed by a first driven roll and a second roll defining a nip therebetween that is part of a transport path through which a substrate is passed, the at least one roll pair being controlled by a registration controller having a predefined drive profile, comprising:

receiving an input selecting one of a variety of different substrate types to be registered by the registration system;

accessing a prestored compensation factor corresponding to the selected substrate type that includes at least an effective drive roll radius based on at least the mass per unit area of the selected substrate type;

adjusting the drive profile of the roll pair based on the obtained compensation factor; and driving the roll pair using the compensated drive profile.

18. The method of registration system control according to claim 17, wherein the compensation factor adjusts the drive profile to change the actual angular speed of the drive roll to yield a desired linear substrate speed.

19. The method of registration system control according to claim 17, wherein the compensation factor adjusts the drive profile to change the number of revolutions the registration system drive roll turns so that a distance traveled by the substrate is adjusted.

20. The method of registration system control according to claim 17, wherein the system includes a substrate database containing physical properties of various substrates, including an identification of mass per unit area, and a lookup table of compensation factors indexed by mass per unit area, further comprising:

locating the substrate type in the substrate database corresponding to the substrate type selected;

querying the substrate database for the mass per unit area of the substrate type selected; and locating the corresponding compensation factor for the queried mass per unit area in the lookup table.

21. The method of registration system control according to claim 17, wherein the registration controller is an open-loop, non-feedback controller and the driven roll is driven by a stepper motor.

* * * * *